US010812917B2

(12) United States Patent
Andersson

(10) Patent No.: US 10,812,917 B2
(45) Date of Patent: Oct. 20, 2020

(54) UNDER-LIP BONE CONDUCTION DEVICE

(71) Applicant: Cochlear Limited, Macquarie University, NSW (AU)

(72) Inventor: Marcus Andersson, Gothenburg (SE)

(73) Assignee: COCHLEAR LIMITED, Macquaire University, NSW (AU)

( * ) Notice: Subject to any disclaimer, the term of this patent is extended or adjusted under 35 U.S.C. 154(b) by 627 days.

(21) Appl. No.: 15/014,183

(22) Filed: Feb. 3, 2016

(65) Prior Publication Data

US 2016/0234611 A1 Aug. 11, 2016

Related U.S. Application Data

(60) Provisional application No. 62/114,279, filed on Feb. 10, 2015.

(51) Int. Cl.
*H04R 25/00* (2006.01)

(52) U.S. Cl.
CPC ..... *H04R 25/554* (2013.01); *H04R 25/606* (2013.01); *H04R 2460/13* (2013.01)

(58) Field of Classification Search
CPC ..... H04R 2460/13; H04R 1/1016
USPC ..... 381/151, 326, 380
See application file for complete search history.

(56) References Cited

U.S. PATENT DOCUMENTS 5,326,349 A * 7/1994 Baraff ..... A61F 2/20 381/70
5,447,489 A * 9/1995 Issalene ..... H04R 25/606 128/864
5,455,842 A * 10/1995 Mersky ..... B63C 11/26 128/200.29
8,023,676 B2 * 9/2011 Abolfathi ..... A61B 5/0028 381/151
8,333,203 B2 * 12/2012 Spiridigliozzi ..... H04R 25/606 128/862
8,622,885 B2 * 1/2014 Mersky ..... H04R 25/554 381/151
8,712,077 B2 4/2014 Abolfathi
2009/0274325 A1 * 11/2009 Abolfathi ..... H04R 25/554 381/151
2011/0007920 A1 * 1/2011 Abolfathi ..... H04R 25/606 381/326
2011/0207990 A1 * 8/2011 Mersky ..... H04R 25/554 600/25

* cited by examiner

*Primary Examiner* — Suhan Ni
(74) *Attorney, Agent, or Firm* — Edell, Shapiro & Finnan, LLC

(57) ABSTRACT

Presented herein are bone conduction devices having housings that are complementary to the recipient's maxillary alveolar process such that the maxillary alveolar process supports the housing within the recipient's mouth.

20 Claims, 10 Drawing Sheets

UNDER-LIP BONE CONDUCTION DEVICE

CROSS-REFERENCE TO RELATED APPLICATIONS

This application claims priority to U.S. Provisional Application No. 62/114,279 entitled "Under-Lip Bone Conduction Device," filed Feb. 10, 2015, the content of which is hereby incorporated by reference herein.

BACKGROUND

Field of the Invention

The present disclosure relates generally to bone conduction devices.

Related Art

Hearing loss, which may be due to many different causes, is generally of two types, conductive and/or sensorineural. Conductive hearing loss occurs when the normal mechanical pathways of the outer and/or middle ear are impeded, for example, by damage to the ossicular chain or ear canal. Sensorineural hearing loss occurs when there is damage to the inner ear, or to the nerve pathways from the inner ear to the brain.

Individuals suffering from conductive hearing loss typically receive an acoustic hearing aid. Hearing aids rely on principles of air conduction to transmit acoustic signals to the cochlea. Typically, a hearing aid is positioned in the ear canal or on the outer ear to amplify received sound. This amplified sound is delivered to the cochlea through the normal middle ear mechanisms resulting in the increased perception of sound by the recipient.

In contrast to acoustic hearing aids, certain types of auditory prostheses, commonly referred to as bone conduction devices, convert a received sound into vibrations. The vibrations are transferred through teeth and/or bone to the cochlea, causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems.

SUMMARY

In one aspect, a bone conduction system is provided. The bone conduction system comprises a housing having a surface that is complementary to an outer surface of a recipient's maxillary alveolar process such that the maxillary alveolar process supports the housing within the recipient's mouth, and a transducer disposed in the housing configured to deliver mechanical output forces to the recipient so as to evoke a hearing percept of a sound signal.

In another aspect, a bone conduction device is provided. The bone conduction device comprises a housing configured be positioned in a recipient's mouth between the recipient's tissue proximate to the mouth opening and the gums, and retained in the mouth through pressure applied by the tissue in the direction of the gums; and a transducer disposed in the housing configured to deliver mechanical output forces to the recipient so as to evoke a hearing percept of a sound signal.

BRIEF DESCRIPTION OF THE DRAWINGS

Embodiments are described herein in conjunction with the accompanying drawings, in which.

DETAILED DESCRIPTION

Embodiments presented herein are generally directed to bone conduction devices having a housing that is complementary to the recipient's maxillary alveolar process such that the maxillary alveolar process supports the housing within the recipient's mouth. The bone conduction devices presented herein, sometimes referred to as under-lip bone conduction devices, are retained in the recipient's mouth without attachment to the recipient's teeth or other structures of the mouth.

Figure 1:
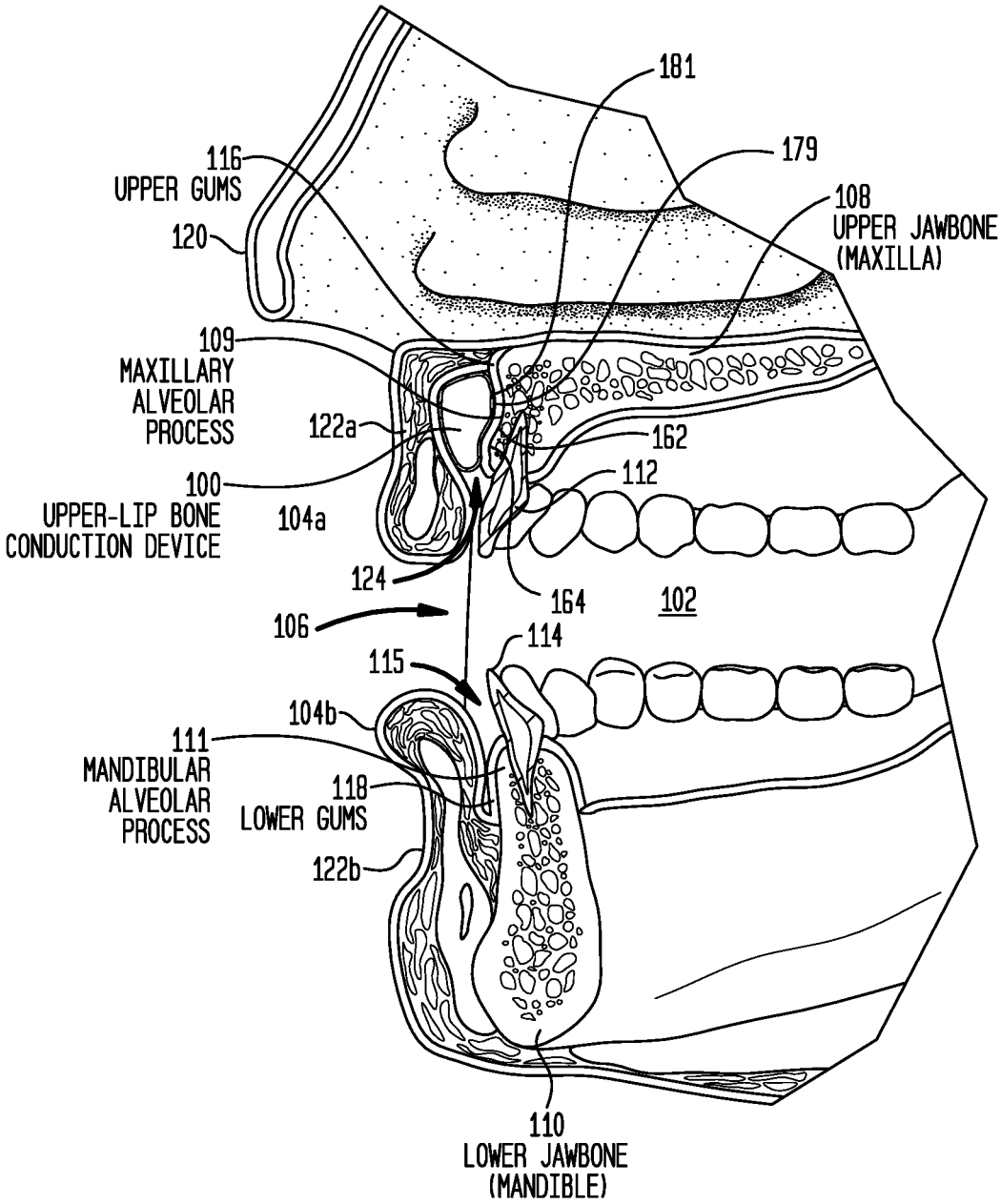
FIG. 1 is a cross-sectional schematic diagram of one embodiment of an exemplary under-lip bone conduction device in accordance with embodiments presented herein.

FIG. 1 is a schematic diagram illustrating an under-lip bone conduction device 100 in accordance with embodiments presented herein. As described further below, the under-lip bone conduction device 100 is configured such that, when positioned in a recipient's mouth 102, the under-lip bone conduction device delivers vibration to rigid/hard tissue (e.g., bones, cartilage, etc.) in the vicinity of the recipient's mouth 102 to evoke a hearing percept.

As shown in FIG. 1, a recipient's lips 104 (i.e., superior/upper lip 104(A) and inferior/lower lip 104(B)) surround a mouth opening 106. The mouth 102 comprises an upper jawbone (maxilla) 108 and a lower jawbone (mandible) 110. The maxilla 108 includes a maxillary alveolar process 109 from which the maxillary/upper teeth 112 extend, while mandible 110 includes a mandibular alveolar process 111 from which mandibular/lower teeth 114 extend. Upper gums 116 enclose the maxillary alveolar process 109 above the upper teeth 112, while lower gums 118 enclose the mandibular alveolar process 111 below the lower teeth 114. It is to be understood that terms such as "upper," "lower," "superior," "inferior, "front," "rear," "side," "interior," "exterior," "inner," "outer," "forward," "rearward," "left," "right," "top," "bottom," and the like as may be used herein, merely describe points or portions of reference and do not limit the present invention to any particular orientation or configuration, unless expressly stated otherwise herein. Further, terms such as "first," "second," "third," etc., merely identify one of a number of portions, components and/or points of reference as disclosed herein, and do not limit the present invention to any particular configuration or orientation.

The recipient's upper lip 104(A) is connected to the recipient's nose 120 by tissue 122(A), while tissue 122(B) extends inferior to the lower lip 104(B). That is, tissue 122(A) forms the outer portion of the mouth 102 that is proximate to the upper gums 116, while tissue 122(B) forms the outer portion of the mouth that is proximate to the lower gums 118. The tissue 122(A) and the upper gums 116 generally define an upper cavity 124 of the mouth 102 that is proximate to the maxillary alveolar process 109). The tissue 122(B) and the lower gums 118 generally define a lower cavity 115 of the mouth 102 that is proximate to the mandibular alveolar process 111.

As shown in FIG. 1, the maxillary alveolar process 109 has an outer surface 162 with a general convex shape that forms a ridge 164 above the upper teeth 112. As described in greater detail below, the under-lip bone conduction device 100 has a corresponding concave shape so as to dovetail with/engage the ridge 164. That is, the under-lip bone conduction device 100 includes a housing having a shape that is complementary to an outer surface of the recipient's upper gums 116 and maxillary alveolar process 109 such that the maxillary alveolar process 109 supports the housing within the mouth.

When the under-lip bone conduction device 100 is engaged with the ridge 164 of the maxillary alveolar process 109, the under-lip bone conduction device 100 has an arrangement (i.e., size and shape) so as to be substantially positioned in the upper cavity 124 of the mouth 102). Therefore, the tissue 122(A) and/or the upper lip 104(A) press the under-lip bone conduction device 100 against the upper gums 116 to assist in retaining the under-lip bone conduction device 100 within the mouth 102 without attachment to the recipient's upper teeth 112 or other structures of the mouth 102.

Merely for ease of illustration, under-lip bone conduction devices in accordance with embodiments presented herein are primarily described herein with an arrangement to be positioned in the upper cavity 124. However, under-lip bone conduction devices in accordance with embodiments presented herein may also be positioned in the lower cavity 115. That is, under-lip bone conduction devices in accordance with embodiments presented herein have an arrangement (i.e., size and shape) so as to be positioned in the lower cavity 115 of the mouth 102. Such an under-lip bone conduction device includes a housing having a front surface with a shape that is complementary to an outer surface of the recipient's lower gums and mandibular alveolar process 111 such that the mandibular alveolar process 111 supports the housing within the mouth (i.e., be configured such that the tissue 122(B) and/or the lower lip 104(B) presses the under-lip bone conduction device against the lower gums 118 to retain the under-lip bone conduction device within the lower cavity 115 of the mouth 102).

Figure 2:
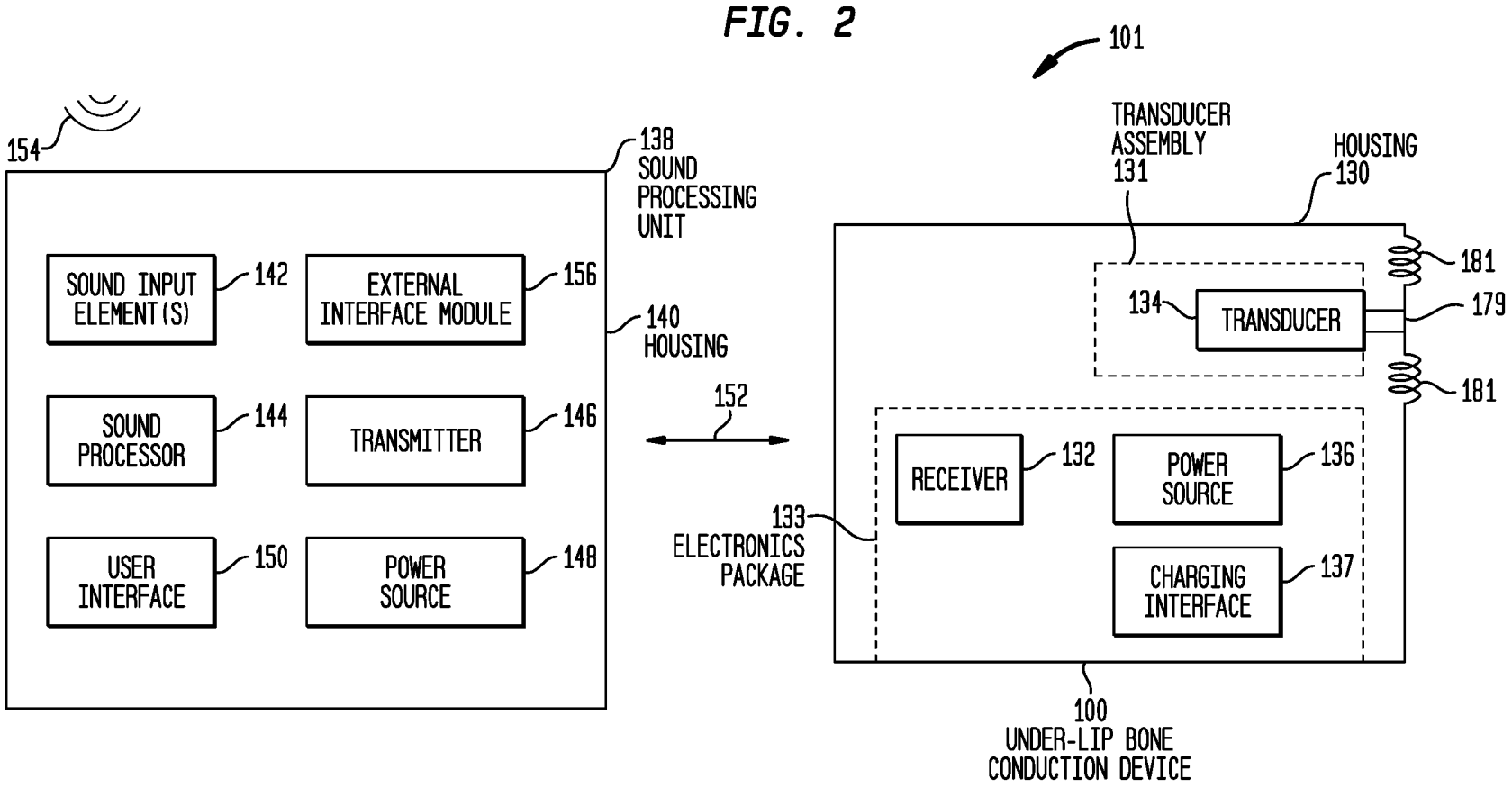
FIG. 2 is a block diagram of a bone conduction system that includes an under-lip bone conduction device in accordance with embodiments presented herein.

FIG. 2 is a functional block diagram illustrating one arrangement of under-lip bone conduction device 100 in accordance with embodiments presented herein. As shown, the under-lip bone conduction device 100 comprises a hermetically-sealed housing 130 that is formed from a biocompatible material. As described further below, the housing 130 has an arrangement (i.e., size and shape) that is complementary to an outer surface of the recipient's upper gums 116 and maxillary alveolar process 109 such that the maxillary alveolar process 109 supports the housing 130 within the mouth 102. Positioned in the housing 130 are a transducer assembly 131 and an electronics package 133. The transducer assembly 131 includes a transducer 134 and, generally, one or more other components assisting operation of the transducer 134 (e.g., transducer drive components). The electronics package 133 comprises a receiver 132 and a power source 136. For ease of illustration, connections between the components of the under-lip bone conduction device 100 have been omitted from FIG. 2.

The power source 136 is configured to supply operational power to the other components of the under-lip bone conduction device 100. The power source 136 is, for example, one or more rechargeable or replaceable/disposable batteries. In embodiments in which the power source 136 is rechargeable, the electronics package 133 also comprises a charging interface 137 that is used to charge power source 136. In one example, the charging interface 137 is an induction coil configured to permit wireless recharging of the power source 136 when located in proximity to a charging base station (not shown in FIG. 2). In alternative embodiments, the charging interface 137 is an energy harvesting component that is activated in response to mechanical actuation (e.g., an internal pendulum or slidable electrical inductance charger actuated through jaw motions) to charge power source 136.

The under-lip bone conduction device 100 operates in conjunction with a sound processing unit 138 that is externally worn by the recipient (i.e., located outside of the mouth 102). The under-lip bone conduction device 100 and sound processing unit 138 are sometimes collectively referred to herein as a "bone conduction system" 101. The sound processing unit 138 includes a housing 140 and is, for example, a behind-the-ear (BTE) sound processing unit, a body-worn sound processing unit, etc. Positioned in and/or on the housing 140 are one or more sound input elements 142, a sound processor 144, a transmitter 146, a power source 148, a user interface 150, an external interface module 156, and/or various other operational components (not shown in FIG. 2). For ease of illustration, connections between the components of sound processing unit 138 have been omitted from FIG. 2.

The power source 148 is configured to supply operational power to the other components of sound processing unit 138. The power source 148 is, for example, one or more rechargeable or replaceable/disposable batteries.

The sound input elements 142 comprise one or more microphones, telecoils, ports, or other devices configured to receive (detect) sound signals in one or more formats (e.g., analog signals or digital signals). User interface 150, which is included in the sound processing unit 138, allows the recipient to interact with the sound processing unit 138 and/or with the under-lip bone conduction device 100. For example, user interface 150 allows the recipient to adjust the volume, alter the speech processing strategies, power on/off the device, etc. As noted, sound processing unit 138 further includes an external interface module 156 that is used to connect the sound processing unit 138 to an external device (e.g., a fitting system, a remote control, etc.).

In operation, a sound input element 142 receives sound signals 154 and outputs electrical signals that represent the received sound signals. These electrical signals are processed by the sound processor 144 to generate processed signals which are provided to transmitter 146. Transmitter 146 and receiver 132 form a wireless link 152 there between that is used to transfer data signals to the under-lip bone conduction device 100. The wireless link 152 between transmitter 146 and receiver 132 is, for example, a radio-frequency (RF) link, infrared (IR) link, electromagnetic link, capacitive link, etc.

As noted, FIG. 2 illustrates the sound processing unit 138 and the under-lip bone conduction device 100 as comprising a transmitter 146 and a receiver 132, respectively (i.e., a unidirectional link). It is to be appreciated that in alternative examples the transmitter 146 and the receiver 132 may each be replaced by a transceiver (i.e., the unidirectional link 152 of FIG. 2 may be replaced by a bidirectional link). In one example, the wireless link 152 is a Bluetooth® link ("Bluetooth" is a registered trademark of BLUETOOTH SIG, INC., Bellevue, Wash.).

Signals transmitted by transmitter 146 are received by receiver 132. The received signals are used to drive/activate transducer 134 so as to generate a mechanical output force in the form of vibrations that are delivered to the recipient. In one example, the vibrations generated by transducer 134 pass through the recipient's soft tissue (e.g., upper gum 116) and are conveyed by rigid tissue (e.g., the maxillary alveolar process 109 and upper maxilla 108), cartilage, etc.) to the recipient's cochlea (not shown), thereby generating motion or vibration of the cochlea fluid. The motion of the cochlea fluid activates the hair cells in the recipient's cochlea. That is, the transducer 134 is configured to generate output forces that cause vibrations that evoke perception of the received sound signals 154.

Transducer 134 may have a number of different arrangements so as to generate mechanical output forces. For example, transducer 134 may be a piezoelectric transducer, an electro-magnetic (EM) transducer, etc. In certain examples, the transducer assembly 131 includes one or components that process/format the signals received from the transmitter 146 for use in driving the transducer 134. This processing/formatting may vary depending on the specific arrangement of the transducer 134 and is not described further herein.

In certain embodiments, the housing 130 is a unitary element to which the transducer 134 is mechanical coupled. However, in other embodiments, the housing 130 includes a housing portion 179 that is vibrationally isolated from the remainder of the housing 130 via an isolation mechanism, such as a plurality of springs 181, compliant/resilient material, etc. The transducer 134 of the under-lip bone conduction device 100 may be attached to the housing portion 179, which is inserted to be in contact with the gums 116. As such, vibration is transferred from the transducer 124 to the gums 116 and maxilla 108.

Figure 3:
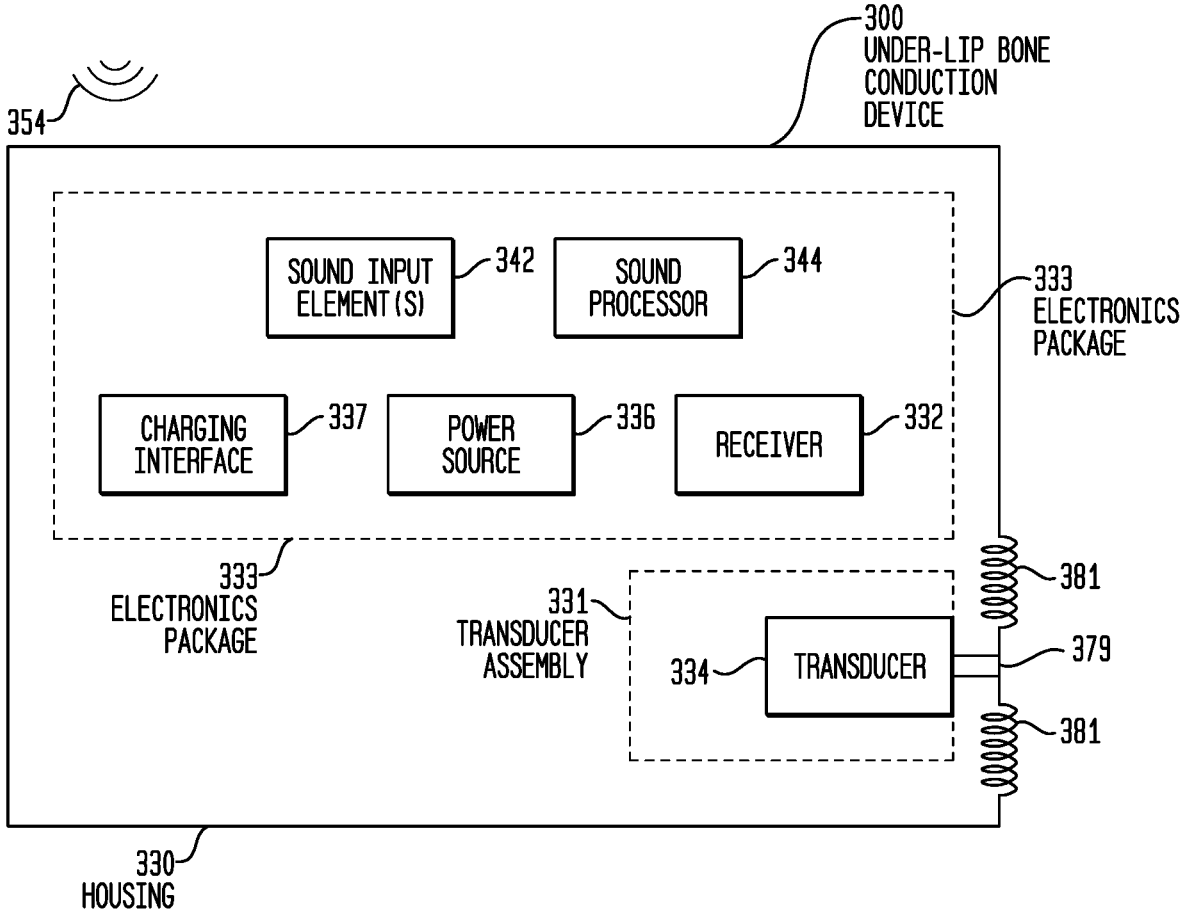
FIG. 3 is a block diagram of an under-lip bone conduction device in accordance with embodiments presented herein.

FIG. 3 is a functional block diagram illustrating an alternative arrangement of an under-lip bone conduction device 300 in accordance with embodiments presented herein. For ease of illustration, the under-lip bone conduction device 300 is described with reference to the recipient's mouth 102 of FIG. 1.

Similar to the arrangement of FIG. 2, the under-lip bone conduction device 300 comprises a hermetically-sealed housing 330 that is formed from, or encapsulated in, a biocompatible material. The housing 330 has an arrangement (i.e., size and shape) that is complementary to an outer surface of the recipient's upper gums 116 and maxillary alveolar process 109 such that the maxillary alveolar process 109 supports the housing 130 within the mouth 102. Positioned in the housing 330 are a transducer assembly 331 and an electronics package 333. The transducer assembly 331 includes a transducer 334 and, generally, one or more other components assisting operation of the transducer 334 (e.g., transducer drive components). The electronics package 333 comprises one or more sound input elements 342, a sound processor 344, a receiver 332 and a power source 236. For ease of illustration, connections between the components of the under-lip bone conduction device 300 have been omitted from FIG. 3.

The power source 336 is configured to supply operational power to the other components of the under-lip bone conduction device 300. The power source 336 is, for example, rechargeable or replaceable/disposable batteries. In embodiments in which the power source 336 is rechargeable, the under-lip bone conduction device 300 also comprises a charging interface 337 that is used to charge power source 336. In one example, the charging interface 337 is an induction coil configured to permit wireless recharging of the power source 336 when located in proximity to a charging base station (not shown in FIG. 3). In alternative embodiments, the charging interface 337 is an energy harvesting component that is activated in response to mechanical actuation (e.g., an internal pendulum or slidable electrical inductance charger actuated through jaw motions) to charge power source 336.

In contrast to the embodiment of FIG. 2, the under-lip bone conduction device 300 does not operate in conjunction with an externally-worn by sound processing unit. Rather, in the embodiment of FIG. 3 the under-lip bone conduction device 300 further comprises one or more sound input elements 342 and a sound processor 344. That is, rather than operating with an externally-worn sound processing unit, the under-lip bone conduction device 300 is configured as a self-contained unit located in mouth 102. In the embodiment of FIG. 3, the sound input elements 342 comprise one or more microphones to receive sound signals 354 and to output electrical signals representative of the sound signals. The sound processor 344 processes these electrical signals for use in driving transducer 334. Transducer 334 is, for example, a piezoelectric transducer, an electro-magnetic (EM) transducer, etc. The one or more sound input elements 342 also comprise one or more elements that are used to identify and/or filter body noise (e.g., accelerometer).

As noted, the under-lip bone conduction device 300 also comprises a receiver 332. The receiver 332 operates as an interface for one or more external devices (e.g., a fitting system, a remote control, etc.).

In certain embodiments, the housing 330 is a unitary element to which the transducer 334 is mechanical coupled. However, in other embodiments, the housing 330 includes a housing portion 379 that is vibrationally isolated from the remainder of the housing 330 via an isolation mechanism, such as a plurality of springs 381, compliant/resilient material, etc. The transducer 334 of the under-lip bone conduction device 300 is attached to the housing portion 379, which is inserted to be in contact with the gums 116. As such, vibration is transferred from the transducer 324 to the gums 116 and maxilla 108.

For ease of illustration, further details of under-lip bone conduction devices in accordance with embodiments presented herein are described with reference to under-lip bone conduction device 100 of FIGS. 1 and 2. However, it is to be appreciated that the additional details may be used in the under-lip bone conduction device 300 or other under-lip bone conduction device arrangements.

Figure 4A:
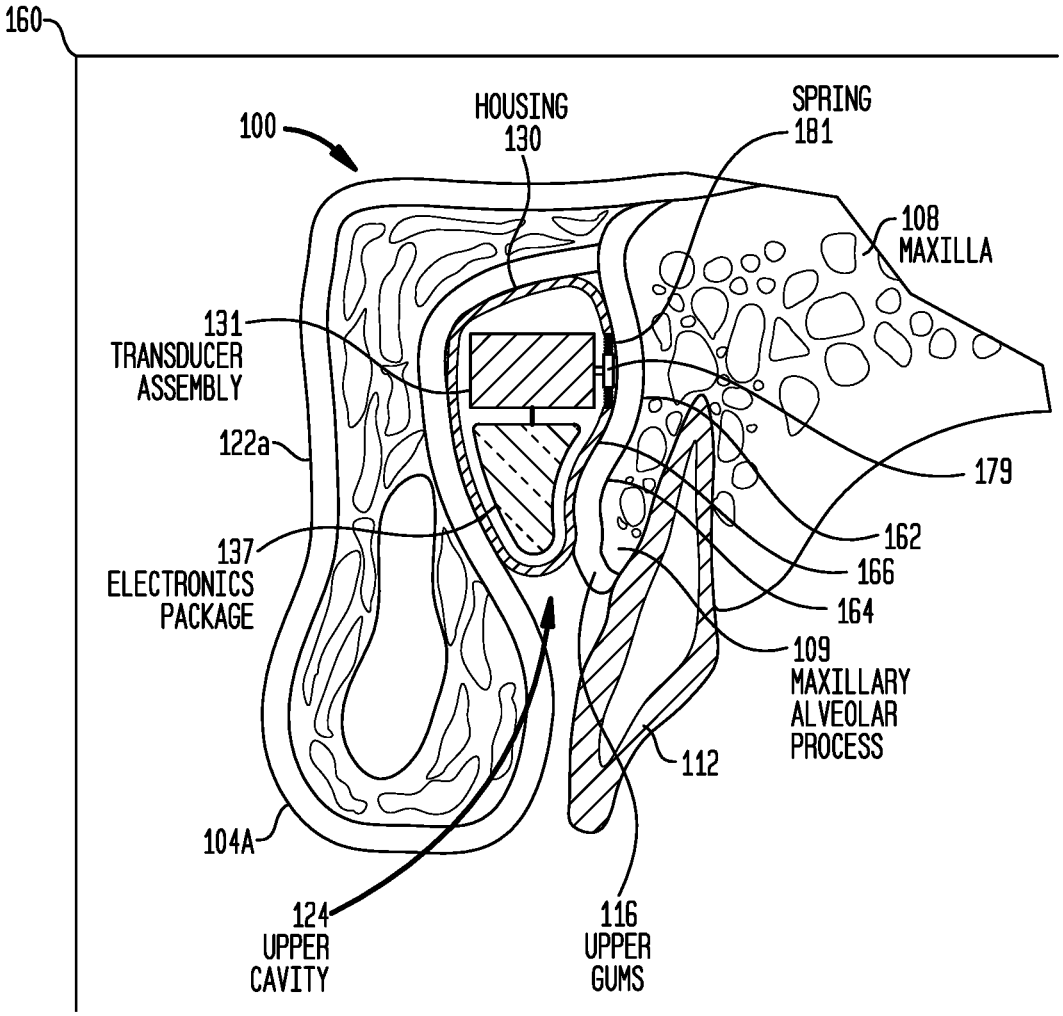
FIG. 4A is a cross-sectional view of an under-lip bone conduction device in accordance with embodiments presented herein which is shown positioned in a recipient's mouth.
Figure 4B:
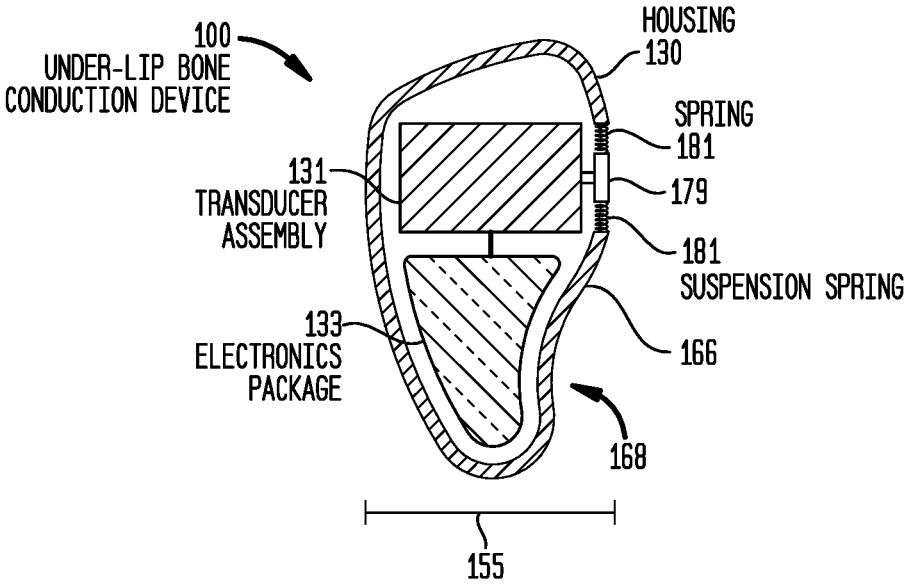
FIG. 4B is a cross-sectional view of the under-lip bone conduction device of FIG. 4A which is shown separate from the recipient's mouth.
Figure 4C:
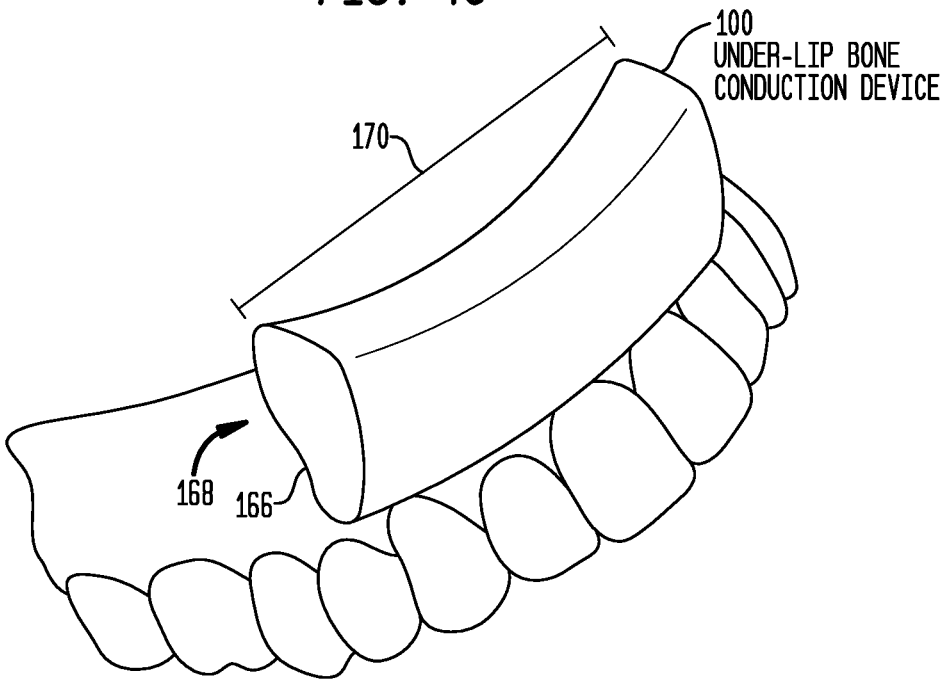
FIG. 4C is a perspective view of the under-lip bone conduction device of FIG. 4A.

FIG. 4A is a schematic cross-sectional view of the under-lip bone conduction device 100 positioned in the recipient's mouth 102. FIG. 4B is a cross-sectional view of the under-lip bone conduction device 100 shown separate from mouth 102, while FIG. 4C is a perspective view of the under-lip bone conduction device 100 positioned in mouth 102. For ease of illustration, the recipient's tissue 122(A) and upper lip 104(A) have been omitted from FIG. 4C.

As shown in FIG. 4A, the upper teeth 112 are rooted in the maxillary alveolar process 109 which is covered by upper gums 116. The outer surface 162 of the maxillary alveolar process 109 has a general convex shape so as to form a ridge 164 above the upper teeth 112. The under-lip bone conduction device 100 has a corresponding concave shape so as to dovetail with/engage the ridge 164. More specifically, as shown in FIG. 4B, the housing 130 has a forward surface 166 that is generally complementary to the outer surface 162 of the maxillary alveolar process 109 and includes an elongate cavity 168 that mates with the ridge 164. In other words, the under-lip bone conduction device 100 has a shape (i.e., cavity 168 extending along the elongate length of front surface 166) so as to be supported within the mouth 102 by the ridge 164.

The under-lip bone conduction device 100 has an outer width 155 that is the same size as, or larger than, the natural width of the upper cavity 124. As such, when the under-lip bone conduction device 100 is positioned on the maxillary alveolar process 109, the recipient's tissue 122(A) and/or the upper lip 104(A) exerts inward pressure on the under-lip bone conduction device 100 (i.e., applies pressure in the direction of the maxillary alveolar process 109). The pressure applied by the tissue 122(A), coupled with the support provided by the maxillary alveolar process 109 retains the under-lip bone conduction device 100 within mouth 102.

A person's "dental arch" refers to the curving shape formed by the arrangement of a normal set of teeth. The inferior dental arch is formed by the mandibular alveolar process 111 and the mandibular teeth 114, while the superior dental arch is formed by the maxillary alveolar process 109 and the maxillary teeth 112. As shown in FIG. 4C, the under-lip bone conduction device 100 has a curved elongate length 170 that matches/follows the curve of the superior dental arch.

Although a person's dental arch is generally curved, the maxillary alveolar process 109 along the dental arch may not form a planar surface. For example, in certain recipient's, the roots of the upper teeth 112 extend out from the maxillary alveolar process 109, thereby creating an undulating surface at the upper gums 116. In certain embodiments, in addition to cavity 168 that extends along the elongate length of front surface 166, the front surface 166 is also undulating so as to match the undulating surface of the upper gums 116.

It is to be appreciated that different recipient's mouths will include anatomical differences (e.g., different undulating surfaces, different ridgelines, etc.). As such, in accordance with examples presented herein, different portions of the housing 130, such as surface 166, are molded to fit a particular recipient. In one example, the front surface 166 is molded in a substantially rigid arrangement that matches the general convex shape (including ridge 164) of the recipient. In other examples, the surface 166 is formed from a material that is in situ moldable and adapts to the recipient's anatomical features, such as the undulating surface of the upper gums 116, each time it is inserted. Materials that may be used in such embodiments include, for example, encapsulated gel, slow recovery foam, a dilatant material, etc.

As shown in FIGS. 4A and 4B, the housing portion 179, which is vibrationally isolated from the remainder of the housing 130 via the plurality of springs 181, abuts the recipient's upper gums 116. The transducer 134 (not shown in FIGS. 4A and 4B) is attached to the housing portion 179 so that vibration is transferred from the transducer 124 to the gums 116 and the maxillary alveolar process 109.

Figure 5:
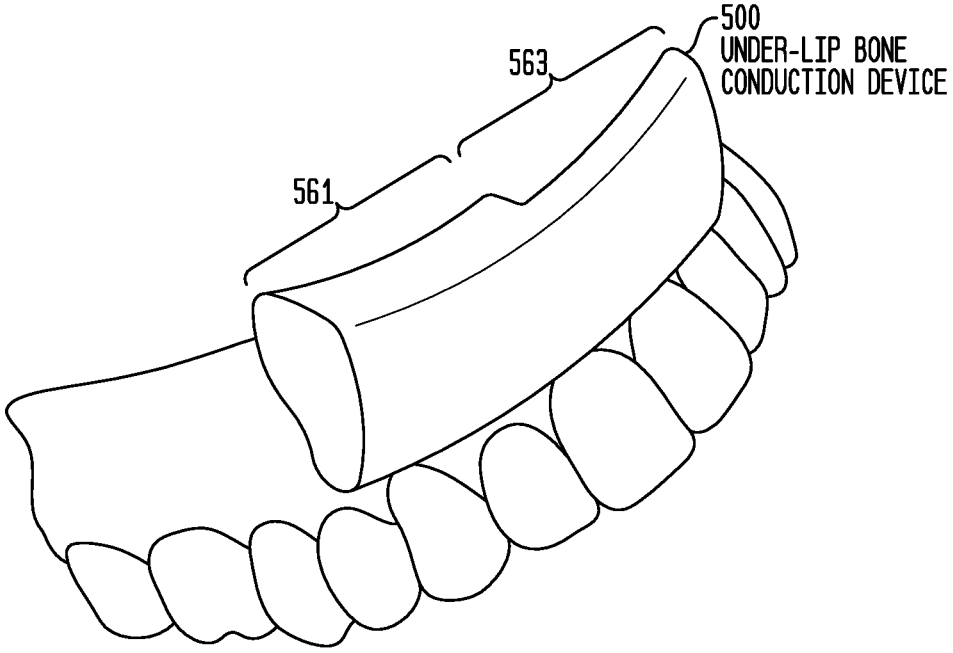
FIG. 5 is a perspective view of another under-lip bone conduction device in accordance with embodiments presented herein.

FIGS. 4A and 4C illustrate one example shape of the under-lip bone conduction device 100 for positioning in upper cavity 124. In these examples, the transducer assembly 131 and electronics package 131 are disposed in a top/bottom (superior/inferior) arrangement where the transducer assembly 131 is located above the electronics package 131. However, under-lip bone conduction devices in accordance with embodiments presented herein may have a number of other arrangements and shapes for positioning in the upper cavity of a recipient' mouth. For example, FIG. 5 is a perspective view of an under-lip bone conduction device 500 that includes a transducer assembly (not shown in FIG. 5) and an electronics package (also not shown in FIG. 5) that are similar to those of under-lip bone conduction device 100. However, in the example of FIG. 5, the transducer assembly and the electronics package are in a side-by-side arrangement. More specifically, the under-lip bone conduction device 500 includes a transducer section 561 in which the transducer assembly is positioned and an adjacent electronics section 563 in which the electronics package is positioned. As shown, the transducer section 561 is larger than the electronics section 563.

As noted above, under-lip bone conduction device 100 has a shape that is generally complementary to the outer surface 162 of the recipient's maxillary alveolar process 109 (i.e., a shape so as to be supported within the mouth 102 by the maxillary alveolar process 109). In certain examples, the support provided by the maxillary alveolar process 109, coupled with inward pressure exerted by tissue 122(A), is sufficient to retain the under-lip bone conduction device 100 in the correct position within mouth 102. However in accordance with certain embodiments presented herein, additional fixation/securement mechanisms may be provided. For example, a temporary adhesive (e.g., denture adhesive power, cream, etc.) can be used to further secure the under-lip bone conduction device 100 in a selected location.

Figure 6:
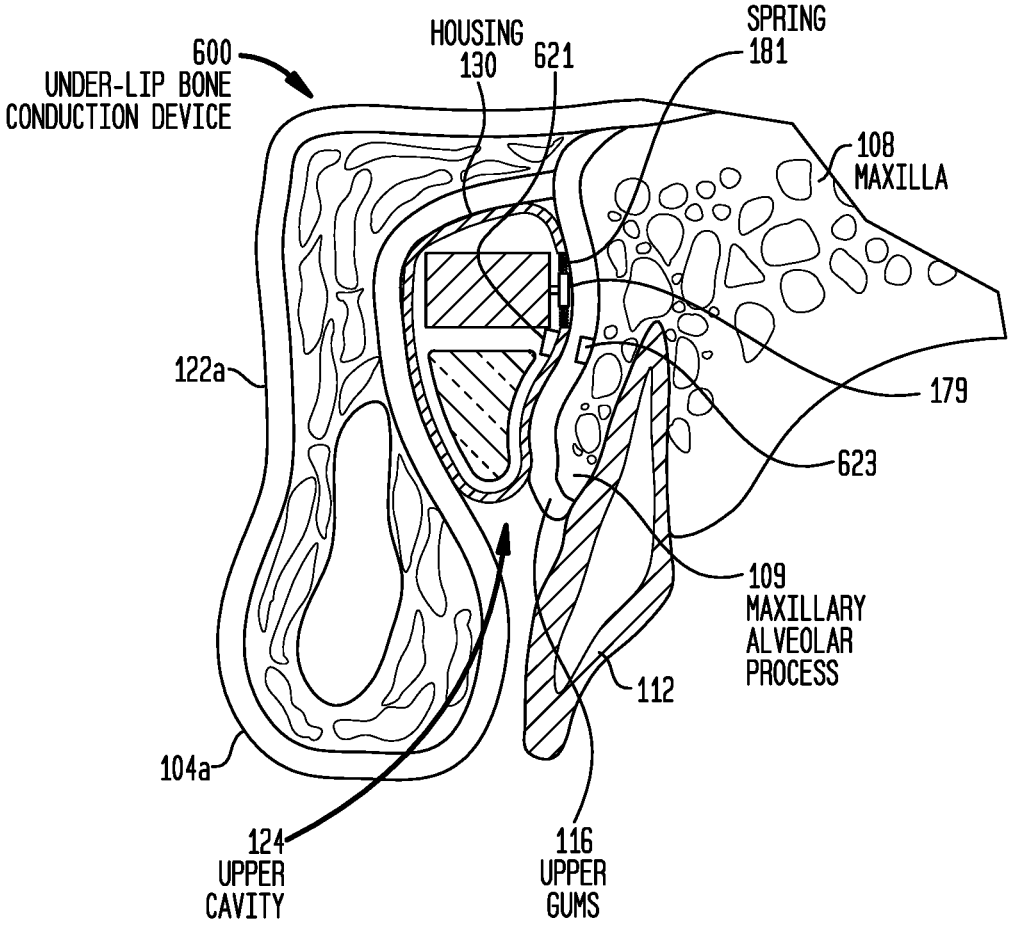
FIG. 6 is a cross-sectional view of an under-lip bone conduction device in accordance with embodiments presented herein which is shown positioned in a recipient's mouth.

FIG. 6 is a cross-sectional view of an under-lip bone conduction device 600 in accordance with further embodiments of the present invention. The under-lip bone conduction device 600 includes a housing 130, a transducer assembly 131, and an electronics package 133, all implemented as described above with reference to FIGS. 2, 4A, and 4B. However, in the example of FIG. 6, the under-lip bone conduction device 600 also includes a first magnet 621 positioned inside, integrated in, or on the housing 130. Also as shown in FIG. 6, a second magnet 623 is implanted adjacent to the maxillary alveolar process 109. The magnets 621 and 623 have opposite polarities at their adjacent faces such that the magnets are magnetically attracted to one another. Therefore, when the under-lip bone conduction device 600 is positioned in the upper cavity 124, the magnets 621 and 623 operate as a securement mechanism to further retain the under-lip bone conduction device 600 within the recipient's mouth 102.

FIG. 6 illustrates an exemplary location for magnets 621 and 623. It is to be appreciated that the magnets 621 and 623 could be positioned at other locations so as to secure the under-lip bone conduction device 600 within the upper cavity 124. It is to be appreciated that the use of two magnets is also illustrative. In other embodiments, multiple magnets are positioned within the housing 130 and are each configured to be magnetically coupled to one or more of the multiple magnets positioned adjacent to the maxillary alveolar process 109. Additionally, although FIG. 6 illustrates the magnets 621 and 623 as being separated from the transducer assembly 131, in other embodiments the magnets 621 and 623 form part of the vibratory pathway. That is, the magnets 621 and 623 may be positioned so as to assist in the transfer of vibration from the transducer assembly 131 to the maxillary alveolar process 109 (i.e., between the transducer and the maxillary alveolar process 109).

As noted above, under-lip bone conduction devices in accordance with embodiments herein have a forward surface that is configured to abut the upper gums 116 of a recipient so as to be positioned adjacent to the maxillary alveolar process 1099 of the recipient. In addition, other surfaces of under-lip bone conduction devices are in contact with other soft tissue (e.g., the tissue 122(A), the upper lip 104(A), etc.). In certain embodiments, one or more surfaces of an under-lip bone conduction device are textured to increase friction between the housing and the soft tissue of the recipient, thereby assisting in retention of the under-lip bone conduction device in the upper cavity of a recipient's mouth. The textured surface(s) function as a securement mechanism to further retain the under-lip bone conduction devices within a recipient's mouth.

Figure 7:
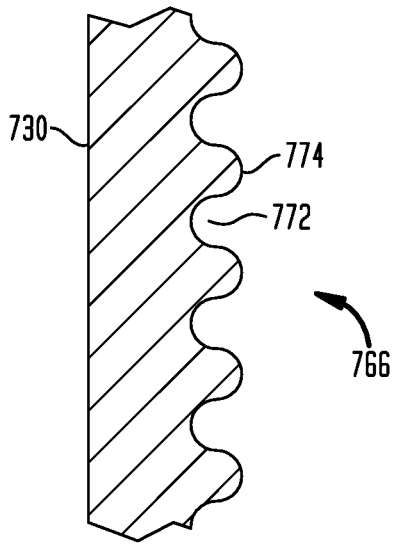
FIG. 7 is a cross-sectional view of a portion of a housing of an under-lip bone conduction device in accordance with embodiments presented herein.

FIG. 7 is a cross-sectional view of a portion of a housing 730 of an under-lip bone conduction device having a textured surface 766 in accordance with embodiments presented herein. In the embodiment of FIG. 7, the surface 766 is textured to include a plurality of recesses in the form of spaced grooves or troughs 772 separated by ridges 774. The grooves 772 are, in this embodiment, elongate concave grooves having a radius of curvature and extending substantially across the surface 766. Similarly, the ridges 774 are elongate convex ridges having a radius of curvature and which extend substantially across the surface 766. In general, the grooves 772 and ridges 774 function to increase the surface area of the surface 766 (relative to a planar surface) so as to increase the friction between the surface 766 and a recipient's upper gums.

As noted, FIG. 7 illustrates embodiments where the grooves 772 and ridges 774 extend substantially across the surface 766. It is to be appreciated that in alternative embodiments the grooves 772 and ridges 774 only extend across one or more portions of the surface 766 to form a symmetrical or an asymmetrical arrangement of grooves/ridges.

FIG. 7 illustrates a specific implementation where grooves 772 are used in combination with ridges 774. In certain embodiments, the grooves 772 are formed through the creation of ridges 774 or vice versa. It is also to be appreciated that other embodiments of surface 766 include only grooves 772 or only ridges 774.

Figure 8:
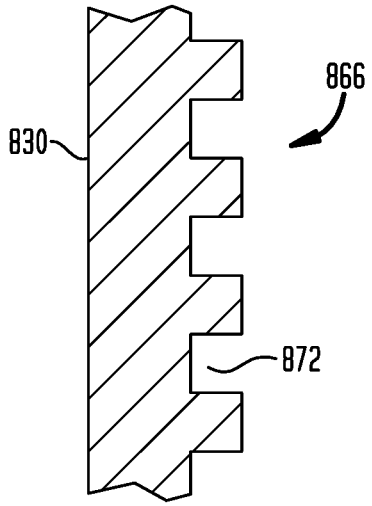
FIG. 8 is a cross-sectional view of a portion of a housing of another under-lip bone conduction device in accordance with embodiments presented herein.

FIG. 8 is a cross-sectional view of a portion of a housing 830 of an under-lip bone conduction device having a textured surface 866 in accordance with embodiments presented herein. In the embodiment of FIG. 8, the surface 866 is textured to include a plurality of recesses in the form of spaced grooves or channels 872 having a substantially square cross-sectional shape. The grooves 872 each extend substantially across the surface 866. In general, the grooves 872 function to increase the surface area of the surface 866 (relative to a planar surface) so as to increase the friction between the surface 866 and a recipient's upper gums.

As noted, FIG. 8 illustrates an embodiment in which the grooves 872 extend substantially across the surface 866. It is to be appreciated that in alternative embodiments the grooves 872 only extend across one or more portions of the surface 866 to form a symmetrical or asymmetrical arrangement of grooves.

FIGS. 7 and 8 illustrate two exemplary arrangements for grooves in accordance with embodiments presented herein. It is also to be appreciated that grooves in alternative embodiments may have different geometries. For example, alternative grooves may be T-shaped, J-shaped, dovetailed, frustoconical, etc.

Figure 9A:
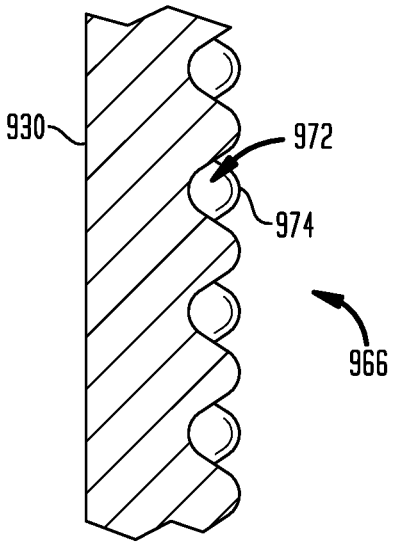
FIG. 9A is a cross-sectional view of a portion of a housing of another under-lip bone conduction device in accordance with embodiments presented herein.
Figure 9B:
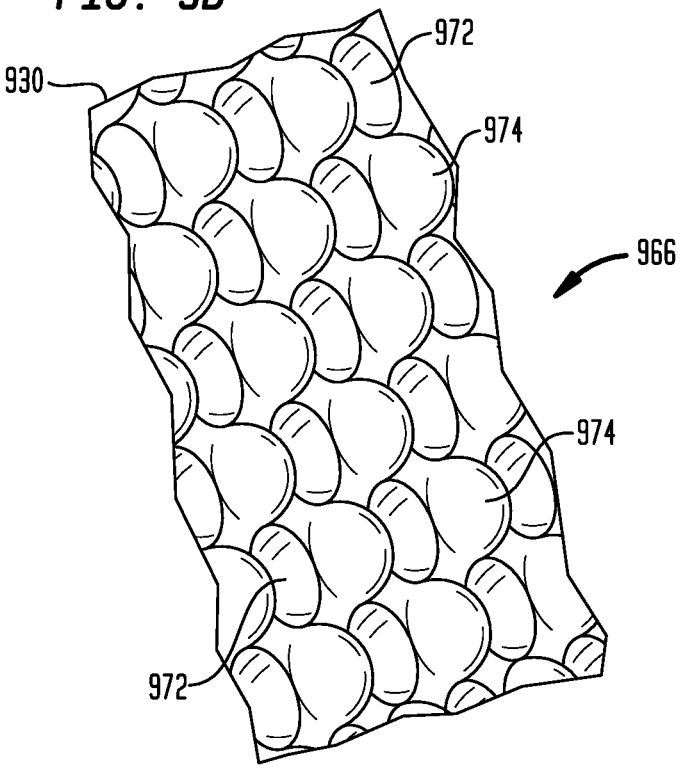
FIG. 9B is a perspective view of a portion of the housing of FIG. 9A.

FIG. 9A is a cross-sectional view of a portion of a housing 930 of an under-lip bone conduction device having a textured surface 966 in accordance with embodiments presented herein. FIG. 9B is a perspective view of the portion of surface 966 of FIG. 9A.

In the embodiment of FIGS. 9A and 9B, the surface 966 is textured to include a plurality of recesses in the form of depressions 972 spaced between protrusions 974. The protrusions 974 have, as shown in FIGS. 9A and 9B, a generally parabolic or dome shape and are disposed across the surface 966. In general, the protrusions 974 function to increase the surface area of the surface 966 (relative to a planar surface) so as to increase the friction between the surface 966 and a recipient's upper gums.

As noted, FIGS. 9A and 9B illustrate embodiments with protrusions 974 having a generally parabolic shape. It is to be appreciated that alternative embodiments may use different shapes (i.e., square, rectangular, arcuate, etc.) for protrusions 974.

Also, FIGS. 9A and 9B illustrate a specific implementation where depressions 972 are used in combination with protrusions 974. In certain embodiments, the depressions 972 are formed through the creation of protrusions 974 or vice versa. It is also to be appreciated that other embodiments of surface 966 may include only depressions 972 or only protrusions 974.

Figure 10A:
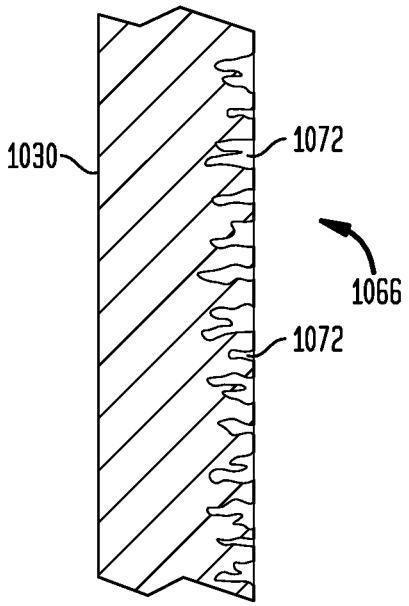
FIG. 10A is a cross-sectional view of a portion of a housing of another under-lip bone conduction device in accordance with embodiments presented herein.
Figure 10B:
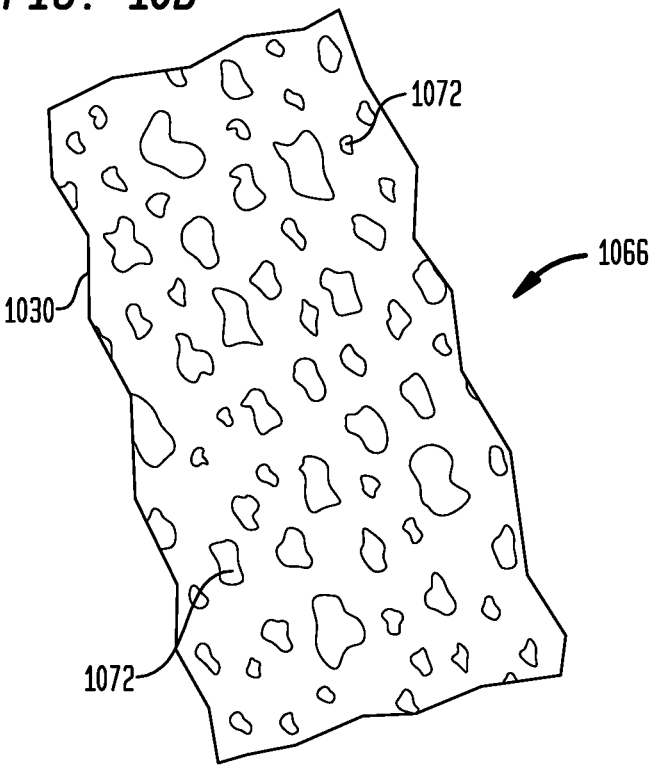
FIG. 10B is a perspective view of a portion of the housing of FIG. 10A.

FIG. 10A is a cross-sectional view of a portion of a housing 1030 of an under-lip bone conduction device having a textured surface 1066 in accordance with embodiments presented herein. FIG. 10B is a perspective view of the portion of surface 1066 of FIG. 9A.

In the embodiment of FIGS. 10A and 10B, the surface 1066 is textured to include a plurality of recesses in the form of pores 1072. In general, the pores 1072 have an irregular arrangement and function to increase the surface area of the surface 1066 (relative to a planar surface) so as to increase the friction between the surface 1066 and a recipient's upper gums. In certain embodiments, the pores 1072 are chemically etched into the surface 1066.

As noted above, embodiments presented herein have been primarily described with reference to an under-lip bone conduction device configured to be positioned in an upper cavity of a recipient's mouth. It is to be appreciated that under-lip bone conduction devices in accordance with alternative embodiments are alternatively configured to be positioned in a lower cavity of a recipient's mouth. Under-lip bone conduction devices configured to be positioned in a lower cavity of a recipient's mouth may have a different shape (e.g., a housing having a front surface with a shape that is complementary to an outer surface of the recipient's lower gums and mandibular alveolar process such that the mandibular alveolar process supports the housing within the mouth), but may otherwise be similar to an under-lip bone conduction device configured to be positioned in the upper cavity of a recipient's mouth.

As described elsewhere herein, under-lip bone conduction devices in accordance with embodiments presented herein are positioned within a recipient's mouth under/behind the upper lip (or possibly the lower lip). The lip and/or adjacent tissue press the under-lip bone conduction devices to the maxillary or mandibular alveolar process to provide solid contact between a transducer within the bone conduction device and the soft tissue adjacent to the maxillary or mandibular alveolar process. As such, vibration generated by under-lip bone conduction devices presented herein pass through the gums to the maxillary or mandibular alveolar process.

It is to be appreciated that the above embodiments are not mutually exclusive and may be combined with one another in various arrangements.

The invention described and claimed herein is not to be limited in scope by the specific preferred embodiments herein disclosed, since these embodiments are intended as illustrations, and not limitations, of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A bone conduction system, comprising:

a housing having a surface that is complementary to an outer surface of a recipient's maxillary alveolar process such that the maxillary alveolar process supports the housing within the recipient's mouth, wherein the surface of the housing includes an elongate cavity configured to mate with a ridge of the maxillary alveolar process; and a transducer disposed in the housing configured to deliver mechanical output forces to the recipient so as to evoke a hearing percept of a sound signal.

2. The bone conduction system of claim 1, wherein at least one surface of the housing is textured to facilitate friction between the housing and the recipient's soft tissue.

3. The bone conduction system of claim 2, wherein the at least one surface is textured to include a plurality of recesses.

4. The bone conduction system of claim 3, wherein the recesses comprise a plurality of elongate grooves and wherein the at least one surface includes a plurality of elongate ridges.

5. The bone conduction system of claim 3, wherein the recesses are pores having irregular shapes.

6. The bone conduction system of claim 3, wherein the recesses are a plurality of depressions and wherein the at least one surface includes a plurality of protrusions.

7. The bone conduction system of claim 1, further comprising:

a receiver disposed in the housing; and a power source disposed in the housing configured to provide power to the receiver and the transducer.

8. The bone conduction system of claim 7, further comprising:

an external sound processing unit that includes:

one or more sound input elements configured to generate electrical signals based on received sound signals;

a sound processor configured to process the electrical signals to generate processed signals representative of the sound signals; and a transmitter configured to wirelessly transmit the processed signals to the receiver.

9. The bone conduction system of claim 7, further comprising:

one or more sound input elements disposed in the housing and configured to generate electrical signals based on received sound signals; and a sound processor disposed in the housing configured to process the electrical signals to generate processed signals representative of the sound signals.

10. The bone conduction system of claim 1, further comprising:

an implantable magnet configured to be implanted adjacent to the maxillary alveolar process; and a magnet disposed in or on the housing and configured to be magnetically coupled to the implantable magnet.

11. The bone conduction system of claim 1, wherein the housing includes a housing portion that is vibrationally isolated from a remainder of the housing via an isolation mechanism, and wherein the transducer is mechanically coupled to the housing portion.

12. A bone conduction device, comprising:

a housing configured to be positioned in a recipient's mouth between the recipient's tissue and gums and retained in the mouth due to inward pressure applied by at least one of the tissue or a lip of the recipient, wherein the housing includes a surface that is textured to facilitate friction between the surface of the housing and the recipient's soft tissue; and a transducer disposed in the housing configured to deliver mechanical output forces to the recipient so as to evoke a hearing percept of a sound signal.

13. The bone conduction device of claim 12, wherein the housing has a front surface with a shape that is complementary to an outer surface of the recipient's maxillary alveolar process such that the maxillary alveolar process supports the housing within the mouth.

14. The bone conduction device of claim 13, wherein the front surface includes an elongate cavity configured to mate with a ridge of the maxillary alveolar process.

15. The bone conduction device of claim 12, wherein the housing has a front surface with a shape that is complementary to an outer surface of the recipient's mandibular alveolar process such that the mandibular alveolar process supports the housing within the mouth.

16. The bone conduction device of claim 12, wherein the surface is textured to include a plurality of recesses.

17. The bone conduction device of claim 12, further comprising:

a receiver disposed in the housing; and a power source disposed in the housing configured to provide power to the receiver and the transducer.

18. The bone conduction device of claim 17, further comprising:

one or more sound input elements disposed in the housing and configured to generate electrical signals based on received sound signals; and a sound processor disposed in the housing configured to process the electrical signals to generate processed signals representative of the sound signals.

19. A bone conduction device, comprising:

a housing configured to be positioned in a recipient's mouth between the recipient's tissue and gums and retained in the mouth due to inward pressure applied by at least one of the tissue or a lip of the recipient, wherein the housing has a surface that includes an elongate cavity configured to mate with a ridge of an outer surface of the recipient's maxillary alveolar process; and a transducer disposed in the housing configured to deliver mechanical output forces to the recipient so as to evoke a hearing percept of a sound signal.

20. The bone conduction device, of claim 19, wherein the surface of the housing is textured to facilitate friction between the surface of the housing and the recipient's soft tissue.

* * * * *